US008845386B2

(12) United States Patent
Kondo

(10) Patent No.: US 8,845,386 B2
(45) Date of Patent: Sep. 30, 2014

(54) APPARATUS AND METHOD FOR THE REMOVAL OF UNIT MEMBERS FROM A TRANSMITTER MECHANISM FOR RC MODELS

(75) Inventor: Hirotoshi Kondo, Tokyo (JP)

(73) Assignee: Kondo Kagaku Co., Ltd., Tokyo (JP)

( * ) Notice: Subject to any disclaimer, the term of this patent is extended or adjusted under 35 U.S.C. 154(b) by 472 days.

(21) Appl. No.: 13/290,869

(22) Filed: Nov. 7, 2011

(65) Prior Publication Data

US 2012/0196507 A1 Aug. 2, 2012

(30) Foreign Application Priority Data

Feb. 1, 2011 (JP) ..... 2011-20063

(51) Int. Cl.

| | |
|---|---|
| ***A63H 30/00*** | (2006.01) |
| ***A63H 17/00*** | (2006.01) |
| ***A63H 17/28*** | (2006.01) |
| ***A63H 30/04*** | (2006.01) |

(52) U.S. Cl.

CPC ..... *A63H 30/04* (2013.01)
USPC ..... 446/465; 446/438; 446/454

(58) Field of Classification Search

CPC ..... A63H 30/04; A63H 17/36
USPC ..... 446/175, 454–456, 484, 487, 438, 465
See application file for complete search history.

(56) References Cited

U.S. PATENT DOCUMENTS

| | | | | |
|---|---|---|---|---|
| 7,029,363 | B2 * | 4/2006 | Ogihara | 446/454 |
| 7,220,160 | B2 * | 5/2007 | Kiuchi | 446/454 |
| 7,374,489 | B2 * | 5/2008 | Sexton | 463/36 |
| 7,553,212 | B2 * | 6/2009 | Yamaguchi | 446/460 |
| 8,616,933 | B2 * | 12/2013 | Yu et al. | 446/310 |
| 2003/0214428 | A1 * | 11/2003 | Tokita | 341/176 |
| 2004/0018800 | A1 * | 1/2004 | Caiozza | 446/454 |

* cited by examiner

*Primary Examiner* — Nini Legesse
(74) *Attorney, Agent, or Firm* — Marcus C. Dawes; Daniel L. Dawes

(57) ABSTRACT

An apparatus and method for coupling a plurality of detachable components from a transmitter unit used to control radio controlled (RC) models. Specifically, a steering unit and a grip unit may be coupled and decoupled from the main upper body unit comprising the transmitter. When coupling the steering unit to the upper body, guide projections on the steering unit are inserted into a corresponding number of groove guides defined within the upper body unit. A shutter stopper locks the guide grooves and prevents the guide projections from moving. The grip unit is similarly coupled to the upper body unit by means of a locking claw which maintains the grip unit in a fixed position until a release button is actuated by a user. The transmitter unit comprises the ability of providing for a number of different operational configurations, thus accommodating the needs and preferences of each user.

16 Claims, 6 Drawing Sheets

APPARATUS AND METHOD FOR THE REMOVAL OF UNIT MEMBERS FROM A TRANSMITTER MECHANISM FOR RC MODELS

RELATED APPLICATIONS

The present application is related to Japanese Application, serial no. 2011-20063, filed on Feb. 1, 2011, which is incorporated herein by reference and to which priority is claimed pursuant to 35 USC 119.

BACKGROUND

1. Field of the Technology

The disclosure relates to the field of RC (radio control) transmitters to send signals for controlling various RC models such as model cars or other vehicles comprising a plurality of reattachable components such as a transmitter unit, a steering unit, and a grip unit.

2. Description of the Prior Art

In conventional radio control transmitter models, a user holds the entire body grip unit in their palm. Typically the upper body portion of the unit is disposed above the grip unit, and a steering type transmitter is attached to a steering wheel within a steering unit disposed in the upper body portion of the unit. Other steering type transmitters may be attached such as a stick or joystick instead of a steering wheel to convert the physical actuation of the user to commands sent to the radio-controlled model. The entire transmitter unit as a whole is generally rectangular-shaped.

Controlling the speed of the radio controlled model is typically performed by using a trigger switch coupled to the steering transmitter or a stick lever coupled to the stick transmitter. The stick transmitter and steering transmitter may be equipped with an extension unit or other various extensions known in the art, such as a battery unit which is disposed within the handle or main housing of the transmitter unit.

Transmitters with analog stick and steering wheel control schemes each typically comprise several components which form an integrated assembly and are difficult to separate or divide from the other components of the transmitter unit which include the grip, upper body, steering unit, trigger, analog stick, extension unit, and portions of the battery unit. The integrated nature of the components of the transmitter unit makes the free exchange or adaptability of each component extremely difficult. The RC transmitter unit is usually manufactured with either an analog stick or steering wheel control scheme, thus rendering the transmitter into something that is not easily changeable or alterable by the user. Therefore, if the user of the transmitter even desired to replace or exchange a component of the transmitter unit for another component, the current prior art cannot meet such a request.

For example, users who wish to use the steering wheel and steering transmitter control scheme or users who wish to use an analog stick control scheme were forced to use whatever control scheme was available since the basic forms of control are so different and typically not interchangeable.

Additionally because 95% of users of RC models prefer the steering wheel control scheme versus 5% of that for analog stick control, it does not provide much financial incentive for manufacturers to sell an assortment of both types of RC transmitter units to dealers in order to meet the needs of a diverse customer base. Furthermore, production costs increase dramatically for manufacturing both types of RC transmitters, thus further adding to the difficulty of providing both types of control schemes to the market place.

What is needed is an RC transmitter that comprises the traditional transmitter components such as a steering unit, grip unit, and upper body while still maintaining the ability for each component of the transmitter to be detached separately with one-touch and combined freely according to the personal preference of a user, allowing for easy replacement for each individual component. The transmitter should be customizable so that the user may decide what is best for their individual needs while maintaining manufacturing costs at a minimum for the manufacturer.

BRIEF SUMMARY

The present invention includes a customizable transmitter for controlling a radio-controlled (RC) vehicle or toy which includes an upper body unit, having a front and bottom surface. A detachable steering unit is removably connected to the front surface of the upper body unit and a detachable grip unit is removably connected to the bottom surface of the upper body unit.

The upper body unit also includes an electrical female receiver defined in the front surface that is capable of being connected to a detachable steering unit which includes a corresponding an electrical male connector.

In another embodiment, the upper body unit includes a plurality of guide grooves defined into the front surface and the detachable steering unit includes a corresponding plurality of guide projections, the guide grooves being accommodated by the corresponding plurality of guide projections disposed on the detachable steering unit. The upper body unit further includes a rotatable shutter disposed within the guide grooves. The shutter locks the guide projections of the detachable steering unit into the guide grooves of the upper body unit. A lever connected to the shutter has the means for rotating the shutter within the guide grooves of the upper body unit.

In yet another embodiment, the upper body unit of the transmitter includes an electrical female socket defined on the bottom surface. The detachable grip unit includes an electrical male plug which is inserted into the electrical female socket.

In yet another embodiment, the upper body unit of the transmitter includes a guide plate disposed on the bottom surface. The detachable grip unit has a top surface with a guide groove which is arranged and configured for accommodating the guide plate disposed on the bottom surface of the upper body unit.

In still a further embodiment, the upper body unit of the transmitter includes a retractable locking claw. The detachable grip unit additionally includes a locking hole which the locking claw may be inserted into the locking hole. Here, the upper body unit also includes means for maintaining the lever in a stationary position until actuated by a user. Furthermore, the upper body unit includes a means for maintaining the locking claw in a stationary position until actuated by a user. The detachable grip unit may further also include a grip release button, a release mechanism on the upper body unit arranged and configured to be actuated by the grip release button, and a rotatable locking lever rotatable over the grip release button to selectively shield the release button from unintentional actuation.

The invention also includes a method for customizing a transmitter used for controlling a radio-controlled (RC) vehicle or toy including providing an upper body unit of the transmitter and detaching or coupling at least one steering or control component from or to the upper body unit of the transmitter.

The method further provides coupling at least one steering or control component to the upper body unit comprises coupling a detachable steering unit to the upper body unit by first inserting a plurality of guide projections disposed on the steering unit into a corresponding plurality of guide grooves defined within the upper body unit. Next, an electrical male connector disposed on the steering unit is connected to an electrical female receiver disposed on the upper body unit. Finally, the steering unit is locked to the upper body unit.

In one embodiment, the method step of at least one steering or control component from the upper body unit includes unlocking the steering unit from the upper body unit. An electrical male connector disposed on the steering unit is then disconnected from an electrical female receiver disposed on the upper body unit. The plurality of guide projections disposed on the steering unit are then removed from a corresponding plurality of guide grooves defined in the upper body unit.

In yet another embodiment, the method further includes coupling a detachable grip unit to the upper body unit by sliding a groove defined on the grip unit over a guide plate disposed on a bottom surface of the upper body unit. An electrical male plug disposed on the grip unit is then connected to an electrical female socket disposed on the upper body unit. Finally, the grip unit is locked to the upper body unit.

In still a further embodiment, the method further includes removing a locking claw disposed in the upper body unit from a locking hole defined in a top surface of a grip unit. An electrical male plug disposed on the grip unit is then disconnected from an electrical female socket disposed on the upper body unit and a groove defined within the top surface of the grip unit is slid from around a guide plate disposed in the upper body unit.

In another embodiment, the method step of locking the steering unit to the upper body includes actuating a lever which is arranged and configured to rotate a shutter disposed within the upper body unit, rotating the shutter which is rotatably fixed to the upper unit through a plurality of gaps defined by the plurality of guide projections defined in the steering unit, and then blocking the plurality of gaps defined by the plurality of guide projections defined in the steering unit with the shutter to prevent the removal of the guide projections defined in the steering unit from the plurality of guide grooves defined in the upper body unit.

In still a further embodiment, the method step of unlocking the steering unit from the upper body unit includes rotating a shutter to an orientation where a plurality of openings in the shutter are aligned with a corresponding plurality of gaps defined between the plurality of guide projections defined in the steering unit allowing removal of the guide projections from the corresponding plurality of guide grooves defined in the upper body unit. A release button is actuated before rotating the shutter.

In another embodiment, the method step of locking the grip unit to the upper body unit includes orientating a locking hole defined in the grip unit beneath a locking claw disposed on the upper body unit. The locking claw is then inserted into the locking hole and a constant downward force is maintained on the locking claw to maintain its position within the locking hole.

Finally, in an alternative embodiment, the method further includes rotating a locking lever and exposing a grip release button, actuating the grip release button, and then retracting the locking claw into the upper body unit.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

DETAILED DESCRIPTION OF THE PREFERRED EMBODIMENTS

Figure 1:
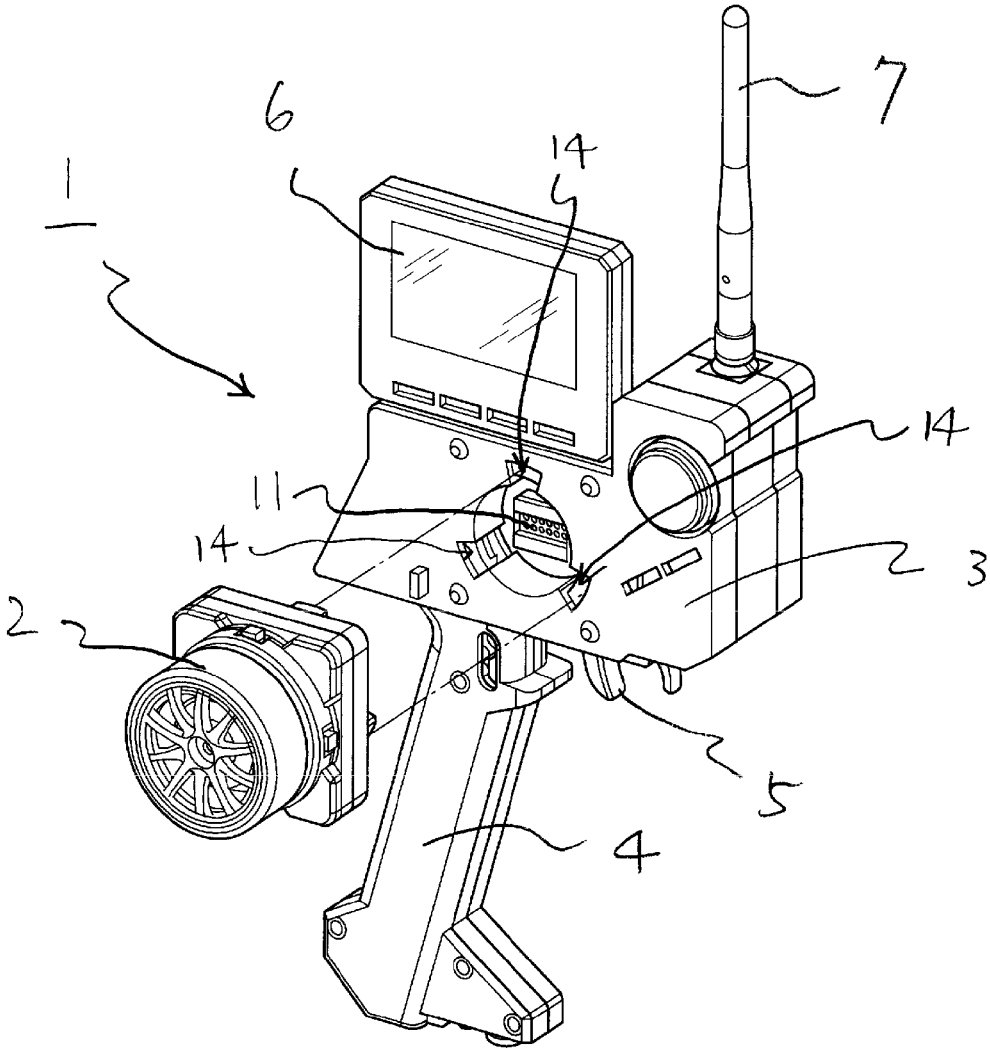
FIG. 1 is a perspective view of the transmitter for a radio-controlled model depicting the steering unit before being coupled to the upper body unit of the transmitter.

A transmitter for controlled radio controlled (RC) models or toys is seen in FIG. 1 and is represented in general with reference numeral 1. The transmitter 1 comprises an upper body unit 3 with a liquid crystal display 6 and an antenna 7 coupled to it. A steering unit 2 which is removeably coupled to the upper body unit 3 is installed into the upper body unit 3 in the direction indicated by the broken lines. A grip unit 4 comprising a trigger 5 is also removeably coupled into the lower portion of the upper body unit 3.

Figure 2:
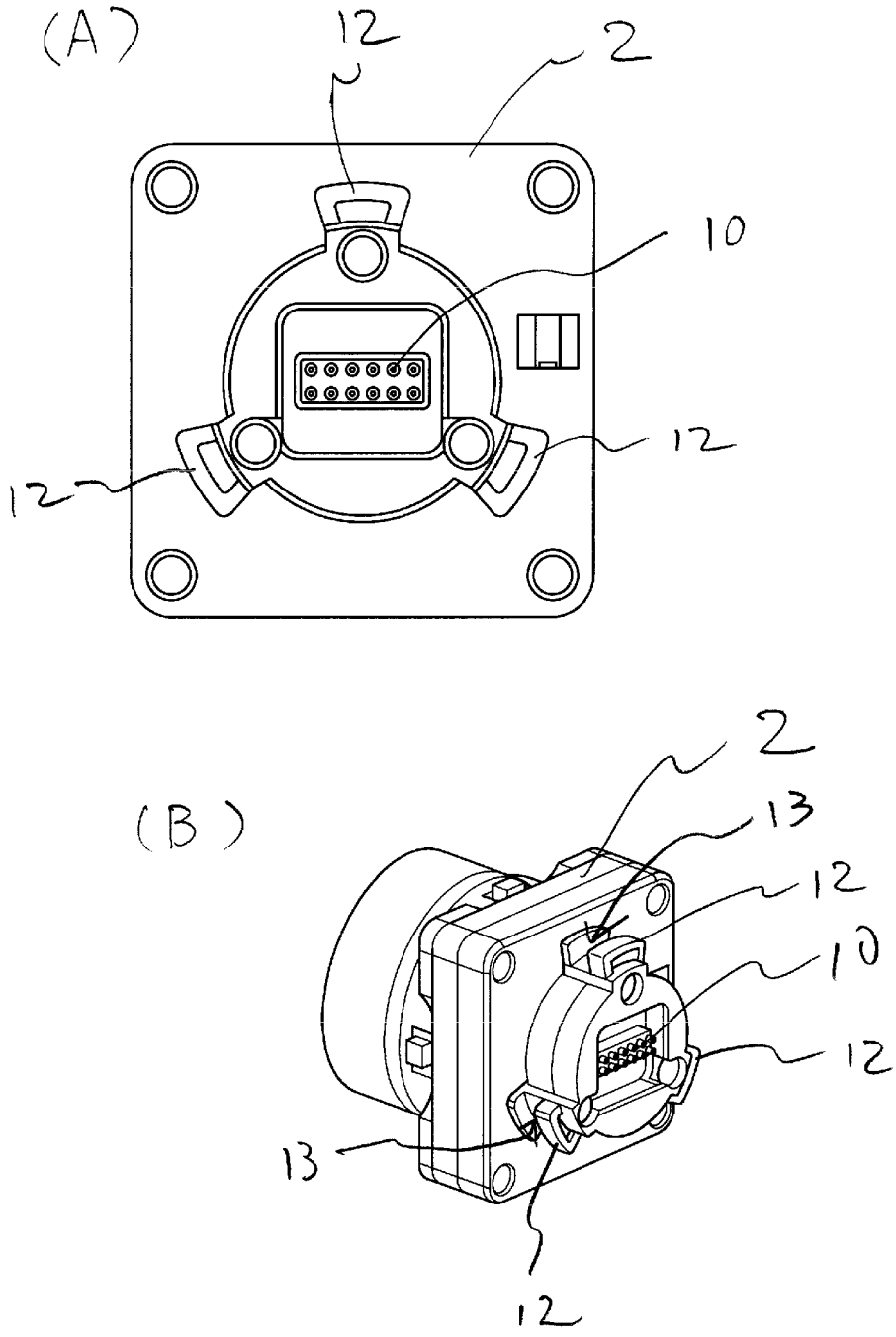
FIG. 2A is a back side view of the steering unit seen in FIG. 1.
FIG. 2B is a perspective rear view of the steering unit seen in FIG. 1.

The rear of the steering unit 2 seen best in FIGS. 2A and 2B comprises a protruding male connector 10. The front of the upper body unit 3 comprises a corresponding female receiver 11 disposed within its front face. The male connector 10 also comprises a side pin with a compressible spring on the back of the steering unit 2. The male connector 10 and female receiver 11 are capable of coupling together and delivering electrical signals to one another, thereby completing an electrical junction as is known in the art between the upper body unit 3 and the steering unit 2.

From the figures it is seen that the steering unit 2 is a wheel steering unit, providing for a steering wheel control scheme for the RC model. It is to be expressly understood however that this is meant to be for illustrative purposes only. Different steering units comprising differing control schemes such as analog sticks or joysticks may be used without departing from the original spirit and scope of the invention.

In order to ensure a proper electrical connection between the upper body unit 3 and steering unit 2, the rear side of the steering unit 2 comprises a plurality of guide projections 12 as seen in FIGS. 2A and 2B that extend from the back surface of the steering unit 2. As seen in FIGS. 2A and 2B, the steering unit 2 comprises three guide projections 12 symmetrically disposed about the male connector 10, however this configuration is meant to be for illustrative purposes only. It is to be explicitly understood that other configurations comprising different numbers of guide projections not shown here may also be well within the spirit and scope of the current invention. Each of the guide projections 12 comprises a notch 13 or gap that is defined between it and the back surface of the steering unit 2 as best seen in FIG. 2B.

Returning to FIG. 1, the front surface of the upper body unit 3 comprises a plurality of defined guide grooves 14 that are sized and shaped to accommodate the guide projections 12 from the steering unit 2 by inserting the guide projections 12 in the distal direction seen in FIG. 1 and then smoothly sliding them into the corresponding guide grooves 14. The steering unit 2 is slid distally into the upper body unit 3 until the male connector 10 contacts and is inserted into the female receiver 11.

Figure 3:
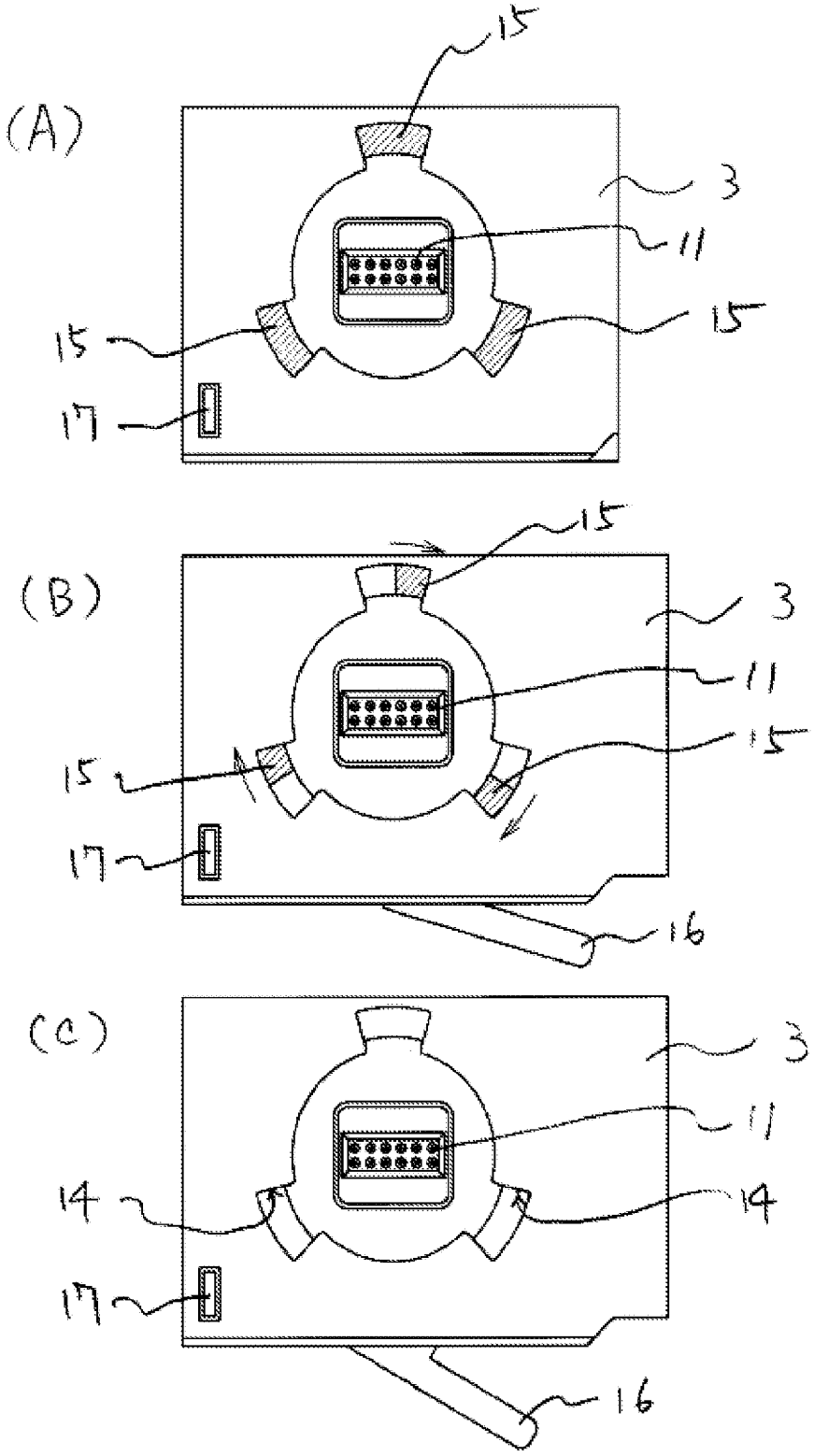
FIG. 3A is a frontal view of the upper body unit seen in FIG. 1 with the shutter of the upper body unit in a locked position.
FIG. 3B is a frontal view of the upper body unit seen in FIG. 1 with the shutter in a semi-open position.
FIG. 3C is a frontal view of the upper body unit seen in FIG. 1 with the shutter in an open position.

In order to prevent unwanted removal of the steering unit 2 from the upper body unit 3, the steering unit 2 is coupled to the upper body unit 3 by means of a "shutter" 15 coupling seen in FIGS. 3A-3C. After the guide projections 12 are inserted into the guide grooves 14, the shutter 15 acts as a rotatable plate-shaped gear that prevents the removal of the steering unit 2 by being rotated through each notch 13 defined in each of the guide projections 12 until the entire notch 13 is blocked by the shutter 15 as seen in FIG. 3A, thus locking the steering unit 2 to the upper body unit 3. The upper body unit 3 also comprises a lever switch 16 which is coupled to the shutter 15. When the lever 16 is vertically actuated as seen in FIG. 3B, the shutter 15 is rotated in the clockwise direction which changes the state of shutter 15 from a locked position to a semi-open position. As the lever 16 is actuated further as seen in FIG. 3C, the shutter 15 continues to rotate clockwise until it has fully rotated through the notches 13 of the steering unit 2 and is clear of the of the guide grooves 14 of the upper body unit 3. The steering unit 2 may then be removed from the upper body unit 3 by pulling the steering unit 2 in the proximal direction and sliding the guide projections 12 from guide grooves 14 defined in the front face of the upper body unit 3.

In one embodiment, a release button 17 disposed on the front face of the upper body unit 3 as seen in FIGS. 3A-3C keeps the lever 16 in a fixed position and so that the lever is not inadvertently moved. To perform the vertical actuation of the lever switch 16 as described above, the release button 17 is first depressed to safely remove the steering unit 2 or to keep the present configuration. If the release button 17 is not pressed, then the lever 16 is blocked from moving, preventing the steering unit 2 from decoupling from the upper body unit 3 carelessly.

In another embodiment, the grip unit 4 may be selectively coupled to the upper body unit 3 of the transmitter 1 as seen in FIGS. 4-6B.

Figure 4:
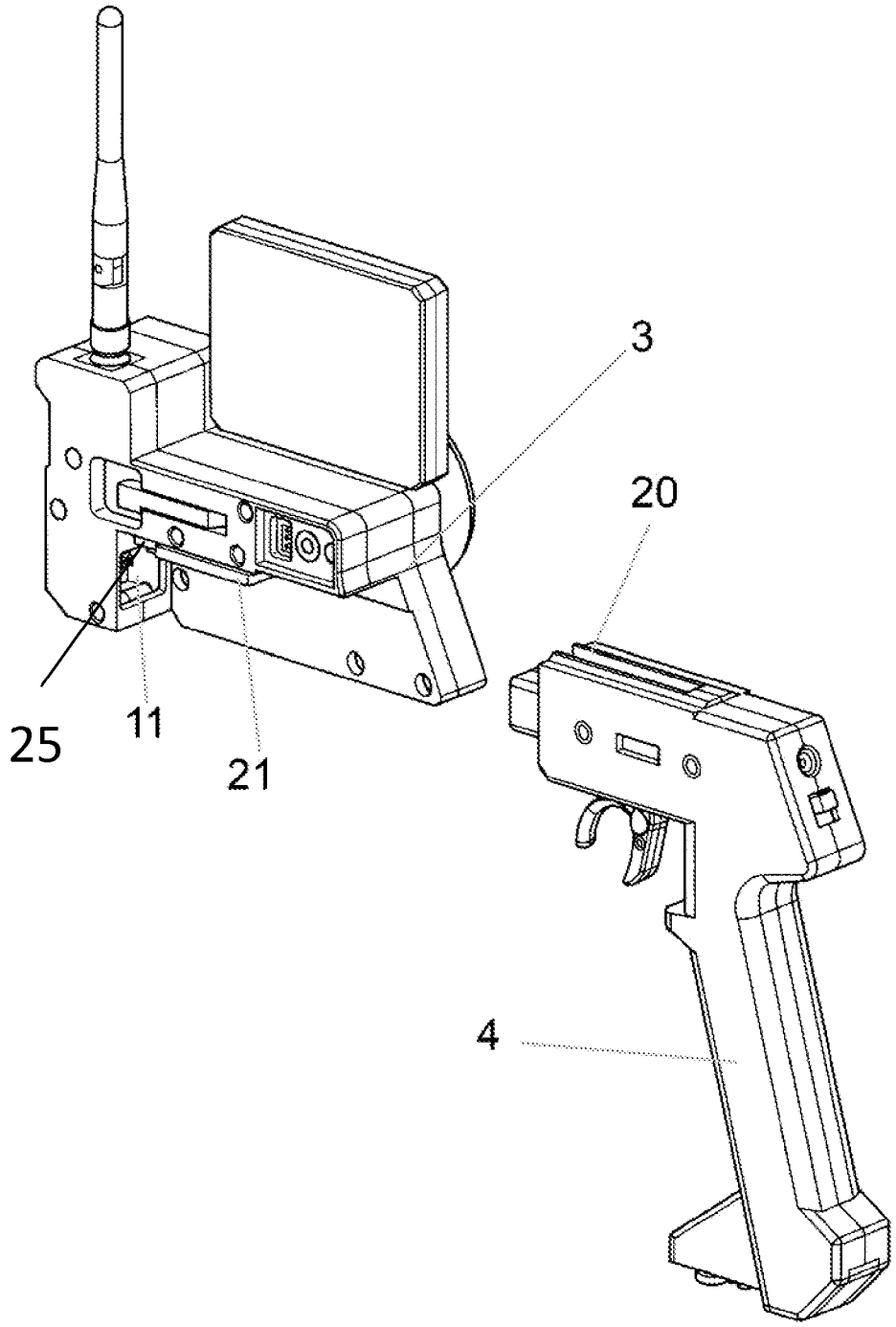
FIG. 4 is perspective view an alternative embodiment of the transmitter for a radio-controlled model depicting the grip unit before being coupled to the upper body unit.

The front end of the grip unit 4 comprises a male plug 30 (best seen in FIG. 5) which forms a mounting surface to couple to a female socket 31 defined in the upper body unit 3 seen in FIG. 4. The male plug 30 comprises a side pin with a compressible spring on the back of the grip unit 24. The male plug 30 and female socket 31 are capable of coupling together and delivering electrical signals to one another, thereby completing an electrical junction as is known in the art between the upper body unit 3 and the grip unit 4.

Figure 5:
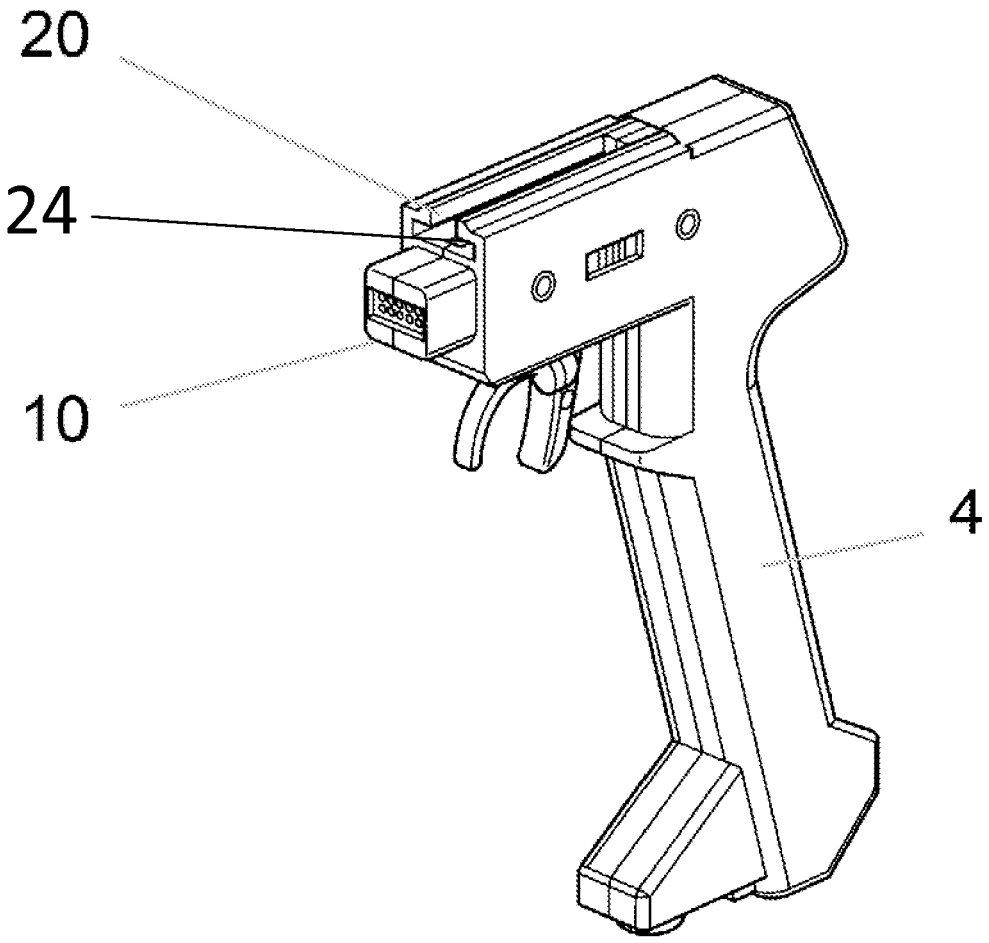
FIG. 5 is a frontal perspective view of the grip unit seen in FIG. 4.
Figure 6:
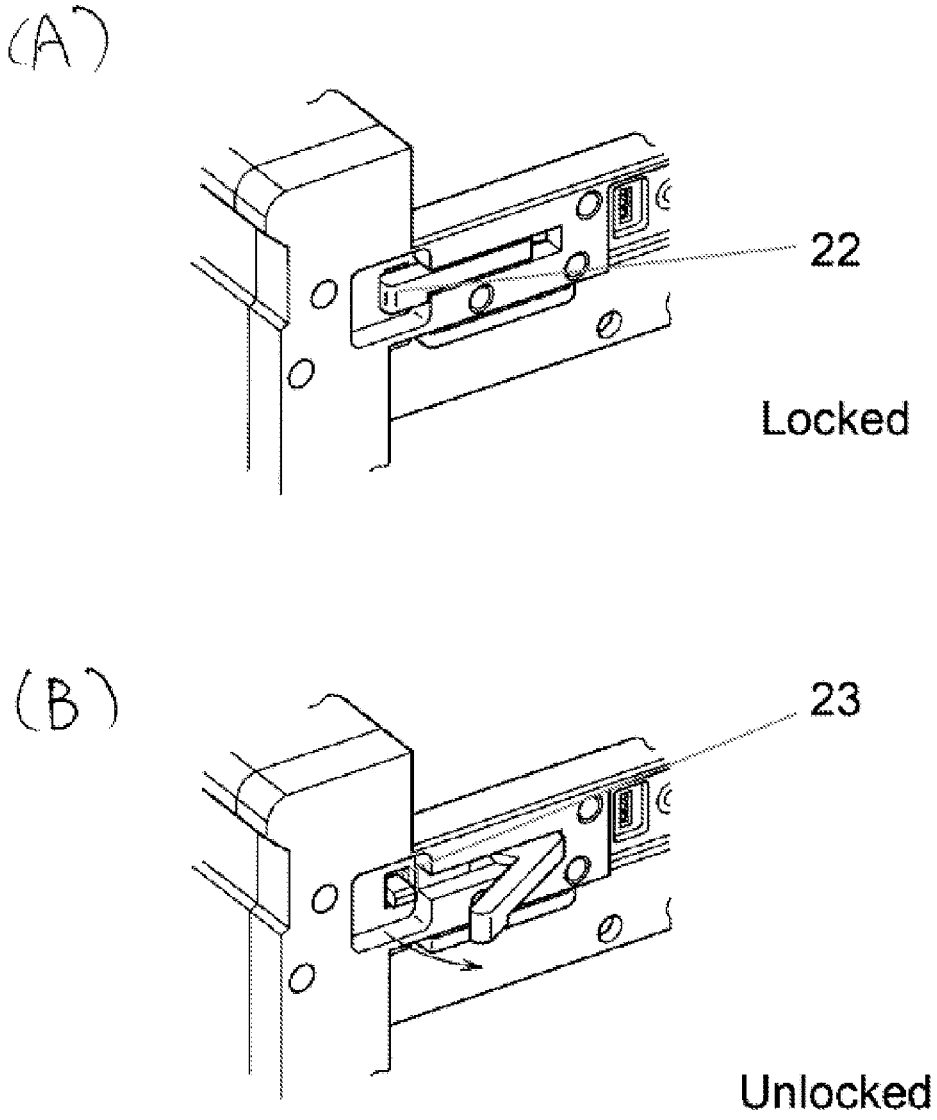
FIG. 6A is a magnified rear view of the upper body unit and the grip unit seen in FIG. 4 with the grip unit shown in a locked position.
FIG. 6B is a magnified rear view of the upper body unit and the grip unit seen in FIG. 4 with the grip unit shown being released from the upper body unit.

In order to ensure a proper electrical connection between the upper body unit 3 and grip unit 4, the grip unit 4 comprises a guide groove 20 defined in its upper surface as seen in FIG. 5. The guide groove 20 is defined substantially along the entirety of the upper surface of the grip unit 4 and comprises an opening on its distal end which corresponds with the direction of insertion into the upper body unit 3.

Disposed on a bottom surface of the upper body unit 3 is a guide plate 21 that is sized and shaped to fit within the groove 20 of the guide unit 4. In order for the grip unit 4 to be coupled to the upper body unit 3, the groove 20 on the guide unit 4 is matched up with the plate 21 disposed on the upper body unit 3. The plate 21 is then mated with the groove 20 which allows the guide unit 4 to be slid smoothly in the distal direction against the upper body unit 3 until the male plug 30 and female socket 31 may be coupled together by means well known in the art.

In one embodiment, the underside of the upper body unit 3 comprises a retractable locking claw 25 seen in FIG. 4 which is biased downward with a constant elastic force. The locking claw 25 is substantially dovetailed in shape and comprises means for engaging a locking hole 24 defined in the grip unit 4 as seen in FIG. 5 to prevent unwanted or accidental removal of the grip unit 4. As the male plug 30 of the grip unit 4 is inserted into the female socket 31 of the upper body unit 3, the locking claw 25 is pushed upward into the upper body unit 3 and out of the way of the incoming grip unit 4. The grip unit 4 continually keeps the locking claw 25 out the way until the locking hole 24 is orientated beneath it, allowing the locking claw 25 to act as a detent mechanism and push back downward and into the locking hole 24. The distal tip of the locking claw 25 is configured to fit and remain within the locking hole 24 with the assistance of the constant downward elastic force provided by a spring or other known means within the upper body unit 3.

In order to avoid an accidental removal, the upper body unit 3 additionally comprises a grip release button 23 and a locking lever 22 as seen in FIGS. 6A and 6B.

Turning to FIG. 6A, the position of locking lever 22 is seen in the locked position. FIG. 6B shows the locking lever 22 in the open position. When the locking lever 22 is in the locked position, removal of the grip unit 4 is impossible as the locking lever 22 covers and prevents the actuation of the grip release button 23. When the locking lever 22 is rotated out into the open position as seen in FIG. 6B, the grip release button 23 is exposed and can be operated by sliding it in the upward direction. As the grip release button 23 is slid upward, the locking claw 25 is pulled upwards out of the locking hole 24 and made flush with the guide plate 21. With the locking claw 25 out of the way, grip unit 4 may be electrically decoupled and removed from the upper body unit 3. After the grip unit 4 is cleared away, the grip release button 23 is slid back to its original position forcing the locking claw 25 into to its original state. While release button 23 is seen substantially as a lever in FIG. 6B, it is to be expressly understood that other means of actuation such as a push button, trigger, or other similar means now known or later devised may also be used without departing from the original spirit and scope of the invention.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

We claim:

1. A customizable transmitter for controlling a radio-controlled (RC) vehicle or toy comprising:

an upper body unit, having a front and bottom surface;

a detachable steering unit removably coupled to the front surface of the upper body unit; and a detachable grip unit removably coupled to the bottom surface of the upper body unit, wherein the upper body unit comprises a plurality of guide grooves defined into the front surface and a rotatable shutter disposed within the guide grooves, wherein the detachable steering unit comprises a corresponding plurality of guide projections, the guide grooves accommodating the corresponding plurality of guide projections disposed on the detachable steering unit, and wherein the shutter locks the guide projections of the detachable steering unit into the guide grooves of the upper body unit.

2. The transmitter of claim 1 where the upper body unit comprises an electrical female receiver defined in the front surface, and where the detachable steering unit comprises an electrical male connector disposed thereon, the electrical female receiver for coupling to the electrical male connector disposed on the detachable steering unit.

3. The transmitter of claim 1 further comprising a lever coupled to the shutter and means for rotating the shutter within the guide grooves of the upper body unit using the lever.

4. The transmitter of claim 3 where the upper body unit comprises means for maintaining the lever in a stationary position until actuated by a user.

5. The transmitter of claim 1 where the upper body unit comprises an electrical female socket defined on the bottom surface, and where the detachable grip unit comprises an electrical male plug, the electrical female socket for coupling to the electrical male plug disposed on the detachable grip unit.

6. The transmitter of claim 1 where the upper body unit comprises a guide plate disposed on the bottom surface, where the detachable grip unit has a top surface and a guide groove defined in the top surface, wherein the guide plate further is arranged and configured for insertion into the guide groove defined on the top surface of the detachable grip unit.

7. The transmitter of claim 1 where the upper body unit comprises a retractable locking claw, where the detachable grip unit includes a locking hole, and wherein the locking claw is arranged and configured for insertion into the locking hole defined on the detachable grip unit.

8. The transmitter of claim 7 where the upper body unit comprises means for maintaining the locking claw in a stationary position until actuated by a user.

9. The transmitter of claim 8 where the detachable grip unit further comprises a grip release button, and where the upper body unit further comprises a release mechanism arranged and configured to be actuated by the grip release button, and a rotatable locking lever rotatable over the grip release button to selectively shield the release button from unintentional actuation.

10. A method for customizing a transmitter used for controlling a radio-controlled (RC) vehicle or toy comprising:

providing an upper body unit of the transmitter; and detaching or coupling at least one steering or control component from or to the upper body unit of the transmitter, wherein coupling at least one steering or control component to the upper body unit comprises coupling a detachable steering unit to the upper body unit comprising the steps of:

inserting a plurality of guide projections disposed in the steering unit into a corresponding plurality of guide grooves defined in the upper body unit;

coupling an electrical male connector disposed on the steering unit to an electrical female receiver disposed on the upper body unit; and locking the steering unit to the upper body unit together by actuating a lever which is arranged and configured to rotate a shutter disposed within the upper body unit, rotating the shutter which is rotatably fixed to the upper unit through a plurality of gaps defined by the plurality of guide projections defined in the steering unit, and blocking the plurality of gaps defined by the plurality of guide projections defined in the steering unit with the shutter to prevent the removal of the guide projections defined in the steering unit from the plurality of guide grooves defined in the upper body unit.

11. The method of claim 10 where detaching at least one steering or control component from the upper body unit comprises:

unlocking the steering unit from the upper body unit;

decoupling an electrical male connector disposed on the steering unit from an electrical female receiver disposed on the upper body unit; and removing the plurality of guide projections disposed on the steering unit from a corresponding plurality of guide grooves defined in the upper body unit.

12. The method of claim 11 where unlocking the steering unit from the upper body unit comprises rotating a shutter to an orientation where a plurality of openings in the shutter are aligned with a corresponding plurality of gaps defined between the plurality of guide projections defined in the steering unit allowing removal of the guide projections from the corresponding plurality of guide grooves defined in the upper body unit, and further comprising actuating a release button before rotating the shutter.

13. The method of claim 10 further comprising coupling a detachable grip unit to the upper body unit by:

sliding a groove defined on the grip unit over a guide plate disposed on a bottom surface of the upper body unit;

coupling an electrical male plug disposed on the grip unit to an electrical female socket disposed on the upper body unit; and locking the grip unit to the upper body unit.

14. The method of claim 13 where locking the grip unit to the upper body unit comprises:

orientating a locking hole defined in the grip unit beneath a locking claw disposed on the upper body unit;

inserting the locking claw into the locking hole; and maintaining a constant downward force on the locking claw to maintain its position within the locking hole.

15. The method of claim 10 further comprising:

removing a locking claw disposed in the upper body unit from a locking hole defined in a top surface of a grip unit;

decoupling an electrical male plug disposed on the grip unit from an electrical female socket disposed on the upper body unit; and sliding a groove defined within the top surface of the grip unit from around a guide plate disposed in the upper body unit.

16. The method of claim 15 further comprising:

rotating a locking lever and exposing a grip release button;

actuating the grip release button; and retracting the locking claw into the upper body unit.

* * * * *